US008853577B1

(12) United States Patent
Tom et al.

(10) Patent No.: US 8,853,577 B1
(45) Date of Patent: Oct. 7, 2014

(54) KEYCAP FOR USE IN BACKLIT KEYBOARDS

(75) Inventors: Kevin Tom, San Francisco, CA (US); Kenneth Ryan Loo, San Jose, CA (US)

(73) Assignee: Google Inc., Mountain View, CA (US)

( * ) Notice: Subject to any disclaimer, the term of this patent is extended or adjusted under 35 U.S.C. 154(b) by 189 days.

(21) Appl. No.: 13/569,526

(22) Filed: Aug. 8, 2012

(51) Int. Cl.
*H01H 9/00* (2006.01)

(52) U.S. Cl.
USPC ..... 200/314

(58) Field of Classification Search
USPC ..... 200/314, 310, 311, 313; 362/23.01, 362/23.03, 23.05, 23.08; 430/131; 264/482
See application file for complete search history.

(56) References Cited

U.S. PATENT DOCUMENTS

| | | | | |
|---|---|---|---|---|
| 5,120,920 | A * | 6/1992 | Moriike | 200/341 |
| 6,036,326 | A * | 3/2000 | Yoshikawa et al. | 362/23 |
| 6,326,569 | B1 * | 12/2001 | Ardrey et al. | 200/314 |
| 6,382,855 | B1 * | 5/2002 | Katori | 400/494 |
| 6,383,721 | B1 * | 5/2002 | Kamimura et al. | 430/320 |
| 6,685,868 | B2 * | 2/2004 | Costin | 264/400 |
| 6,696,008 | B2 * | 2/2004 | Brandinger | 264/400 |
| 6,824,288 | B2 | 11/2004 | Prindle | |
| 7,705,870 | B2 * | 4/2010 | Sato | 347/240 |
| 7,847,204 | B2 * | 12/2010 | Tsai | 200/314 |
| 2010/0051431 | A1 * | 3/2010 | Yeh et al. | 200/314 |
| 2011/0219964 | A1 | 9/2011 | Chen | |

* cited by examiner

*Primary Examiner* — Vanessa Girardi
(74) *Attorney, Agent, or Firm* — Lerner, David, Littenberg, Krumholz & Mentlik, LLP

(57) ABSTRACT

In one aspect, a keycap for use in backlit keyboards is provided. The keycap includes a translucent base having a surface with a layer of paint applied directly onto the surface. The layer of paint is capable of blocking at least some light that passes through the translucent base when the keycap is backlit. A groove is etched on the surface that defines the shape of a symbol. The groove penetrates the layer of paint completely, thus exposing parts of the translucent base that are hidden underneath the layer of paint. Because the translucent base is exposed by the groove, when the keycap is backlit, the symbol may appear to glow while the rest of the keycap's surface may appear to remain dark. The symbol may be a letter, number, or any other symbol one might want to put on a keyboard key.

14 Claims, 4 Drawing Sheets

KEYCAP FOR USE IN BACKLIT KEYBOARDS

BACKGROUND

Electronic devices often include backlit keyboards for receiving user input. Keys in the backlit keyboards may contain symbols screen printed on keycaps and illuminated by a light source disposed underneath the keycaps. The light source may emit light across the keycaps, backlighting the symbols and causing them to be visible when it is dark.

SUMMARY

In one aspect, a keycap for use in backlit keyboards is provided. The keycap includes a translucent base having a surface with a layer of paint applied directly onto the surface. The layer of paint is capable of blocking at least some light that passes through the translucent base when the keycap is backlit. A groove is laser-etched on the surface that defines the shape of a symbol. The groove penetrates the layer of paint completely, thus exposing parts of the translucent base that are hidden underneath the layer of paint. Because the translucent base is exposed by the groove, when the keycap is backlit, the symbol may appear to glow, while the rest of the keycap's surface may appear to remain dark. The symbol may be a letter, number, or any other symbol one might want to put on a keyboard key.

In another aspect, a keycap for use in backlit keyboards is provided that includes a translucent base, a layer of first paint, and a groove etched on the surface of the translucent base. The translucent base has a surface having a first thickness. The layer of first paint is applied directly to the surface of the translucent base. The layer of first paint has a second thickness and is capable of blocking at least some light that flows through the translucent base. The groove extends completely through the second thickness of the layer of first paint and defines a shape of a symbol by exposing parts of the translucent base that are hidden underneath the layer of first paint.

The layer of first paint may be the only paint layer between the translucent base and the layer of clear paint. The layer of first paint, in some instances, may be opaque and capable of blocking completely any light flowing through the translucent base. The groove may further extend partially through the first thickness of the surface without penetrating the first thickness completely. The keycap may further include a layer of clear paint at least partially covering the layer of first paint. The clear paint may at least partially fill the groove, thus leaving a tactile recess on the keycap. Alternatively, the clear paint may substantially fill the groove, thereby causing the groove to appear substantially smooth to a user's touch.

In another aspect, a backlit keyboard comprising a light source and a keycap is provided that includes a translucent base, a layer of first paint, and a groove. The translucent base includes a surface having a first thickness. The layer of first paint is applied directly to the surface of the translucent base and it has a second thickness. The layer of first paint is capable of blocking at least some light emitted from the light source that flows through the translucent base. The groove is etched on the surface of the translucent base and extends completely through the second thickness of the layer of first paint. The groove defines a shape of a symbol by exposing parts of the translucent base that are hidden underneath the layer of first paint.

The layer of first paint may be the only paint layer between the translucent base and the layer of clear paint. The layer of first paint, in some instances, may be opaque and capable of blocking completely any light flowing through the translucent base. The groove may further extend partially through the first thickness of the surface without penetrating the first thickness completely. The keycap may further include a layer of clear paint at least partially covering the layer of first paint. The clear paint may at least partially fill the groove, thus leaving a tactile recess on the keycap. Alternatively, the clear paint may substantially fill the groove, thereby causing the groove to appear substantially smooth to a user's touch.

In yet another aspect, a method is provided for manufacturing a keycap. The method includes adding a predetermined amount of a filler to an original resin to produce a treated resin. The treated resin is translucent and it allows less light to pass through than the original resin. The treated resin is used to produce a translucent keycap base from the treated resin. The method further includes applying a layer of first paint to the translucent keycap base. The layer of first paint is capable of blocking at least some light flowing through the translucent keycap base. The method further includes etching an inscription of a symbol onto the translucent keycap base. The etching creates a groove penetrating the layer of paint thereby enabling light to flow through the inscription without being obstructed by the layer of first paint.

The predetermined amount of filler may further depend on a brightness of a light source that is designated to backlight the keycap. The depth of the groove may further depend on a brightness of a light source that is designated to backlight the keycap. Furthermore, the method may further include applying a layer of clear paint onto the translucent keycap base. The clear paint may only partially fill the groove, thus leaving a tactile recess on the keycap. Alternatively, the clear paint may substantially fill the groove, thereby causing the inscription to appear substantially smooth to a user's touch.

In yet another aspect, a method for manufacturing a keycap is provided. The method includes adding a predetermined amount of filler to an original resin to produce a treated resin. The treated resin is translucent and it allows less light to pass through than the original resin. The method further includes producing a translucent sheet from the treated resin. The method further includes applying a layer of first paint to the translucent sheet, the layer of first paint being capable of blocking at least some light flowing through the translucent sheet. The method further includes, etching onto the translucent sheet an inscription of a symbol. The etching creates a groove penetrating the layer of paint thereby exposing the translucent sheet and enabling light to flow through the inscription without being obstructed by the layer of first paint. The method further includes cutting a portion of the sheet that includes the etched symbol and pressing the cut portion into a desired shape to form the keycap.

The predetermined amount of filler may further depend on a brightness of a light source that is designated to backlight the keycap. The depth of the groove may further depend on a brightness of a light source that is designated to backlight the keycap. Moreover, the method may further include applying a layer of clear paint onto the translucent sheet. The clear paint may only partially fill the groove, thereby leaving a tactile recess on the translucent sheet. Alternatively, the clear paint may substantially fill the groove, thereby causing the inscription to appear substantially smooth to a user's touch.

BRIEF DESCRIPTION OF THE DRAWINGS

FIG. 1E depicts a schematic diagram of a keyboard the keycap of FIG. 1A might be part of.

DETAILED DESCRIPTION

Figure 1A:
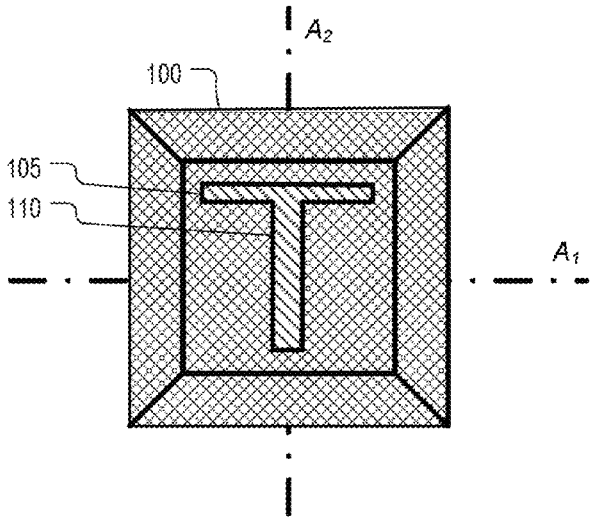
FIG. 1A depicts a top view of a keycap in accordance with aspects of the disclosure.
Figure 1B:
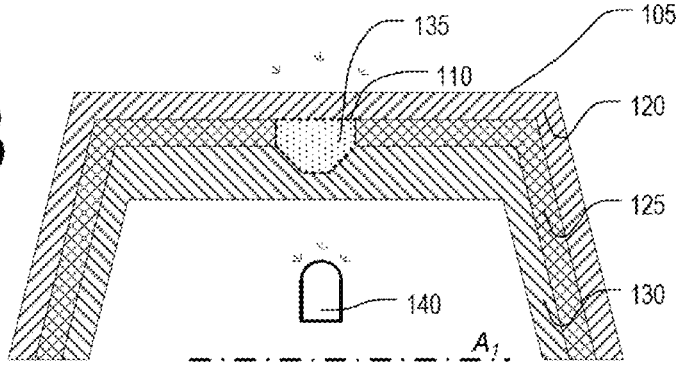
FIG. 1B depicts a cross-sectional view of the keycap of FIG. 1A.
Figure 1C:
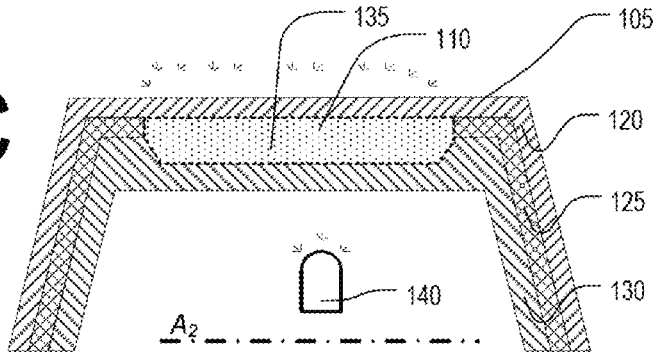
FIG. 1C depicts another cross-sectional view of the keycap of FIG. 1A.

FIGS. 1A-C depict schematic diagrams of a keycap 100. As illustrated in FIG. 1A, the keycap 100 may include a symbol inscription 110 etched onto a top surface 105. The symbol may be a letter, number, or any other type of symbol. The keycap 100 may have the shape of a frustum of a pyramid, a flat plate, a concave plate, a convex plate, a cylinder, a cube, or any other geometric shape. When in use, the keycap 100 may be coupled to a switch of a keyboard or another device that is used for receiving tactile input from one or more users. Furthermore, when in use, the keycap 100 may be backlit by a light source 140 as shown in FIG. 1B. The light source 140 may be a light emitting diode (LED) or any other type of light source capable of being used in backlit keyboard applications.

FIGS. 1B and 1C depict cross-sectional diagrams of the keycap 100 along the axes $A_1$ and $A_2$, respectively. As illustrated, the keycap 100 may include a resin base 130 covered with a base coat of paint 125 and further covered with a top coat of clear paint 120. In one aspect, the resin base 130 may be translucent in order to allow light emitted from the light source 140 to travel across its body. At the same time, however, the base 130 may not be fully transparent and it may block from view inner keyboard components that are located beneath the keycap 100. A desired level of translucency may be imparted on the base by adding filler to an original resin that is used to mold the base 130. The original resin may be a clear resin and adding the filler to the original resin may result in a treated resin that is less transparent that the original resin. Furthermore, the filler may add color to the original resin.

The base coat 125 may be opaque, or at the very least, it is selected to block at least some of the light emitted by the light source 140 that has travelled across the body of the base 130. The symbol inscription 110 may be defined by a groove 135 that is etched into the base coat 125. The groove may extend trough the base coat 125 thereby exposing the base 130. Because the groove 135 exposes portions of the base 130, light emitted by the light source 140, that would be otherwise blocked by the base coat 125, may escape through the symbol inscription 110. Accordingly, when viewed in a dark environment, the symbol inscription 110 may appear to glow while the rest of the surface 105 may remain dark. Conversely, when viewed in a well-illuminated environment, the symbol may have the color of the base 130. In that regard, the base coat 125 and the base 130 may have different colors in order for the symbol inscription 110 to stand out in well-illuminated settings.

Figure 1D:
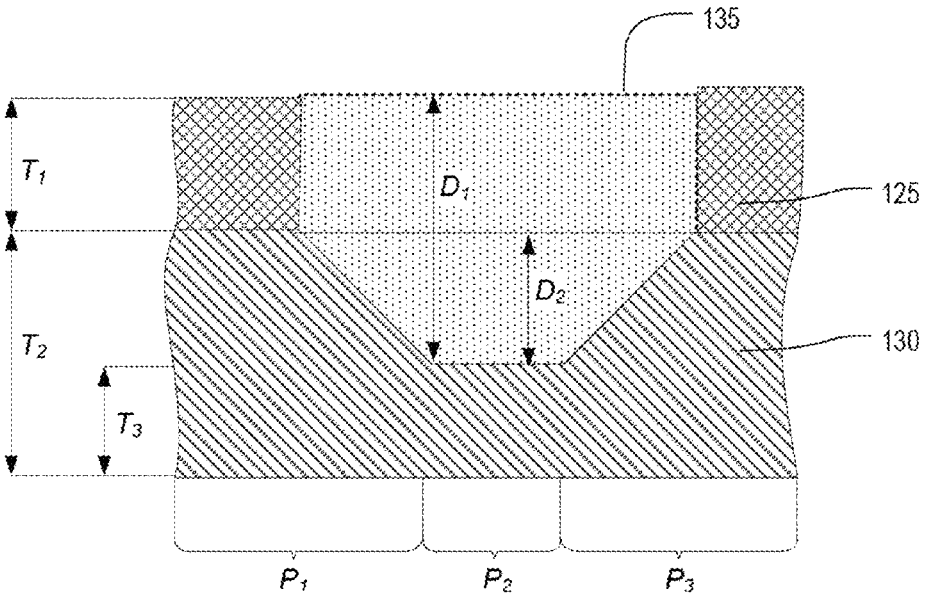
FIG. 1D depicts a cross-sectional view of a groove that is etched into the keycap of FIG. 1A.

FIG. 1D depicts a schematic diagram of the groove 135. As illustrated, the groove 135 may extend to a total depth of $D_1$ through the keycap 100. More particularly the groove 135 may extend through the full thickness $T_1$ of the base coat 120, and may also extend to depth $D_2$, though less than the full thickness $T_2$ of the base 130. The depth $D_2$ may be 1 micron, 10 microns, or any other depth. In one example, the depth $D_2$ may depend on the thickness $T_2$. For instance, the depth $D_2$ may be equal to 10%, 20%, or 50% of the thickness $T_2$.

In one aspect, the groove 135 may be substantially filled with clear paint thereby causing the top surface 105 to appear substantially smooth to a user's touch. In another aspect, the groove 135 may be left unfilled or filled only partially with the clear paint, thereby leaving a tactile recess on the top surface. The tactile recess may further facilitate the recognition of the symbol encryption 110 in poorly-illuminated settings. The clear paint may be part of the clear coat 120.

In another aspect, the portion $P_2$ of the base 130 that is situated underneath the groove 135 may be thinner than the portions $P_1$ and $P_3$. The thinner the portion $P_3$, the more translucent. Thus, in one aspect, by varying the depth $D_2$ to which the groove 135 reaches into the base 135, the brightness of the glow emitted from the symbol inscription 110 may be regulated. Regulating the brightness of the glow may be desirable because excessive brightness may be irritating for some users. Accordingly, when the keycap 110 is manufactured, the depth $D_2$ may be calculated based on the brightness of light emitted by the light source 140 and a desired brightness of the glow from the symbol inscription 110 when it is backlit (e.g., brightness of glow specified by a product specification).

In yet another aspect, the base coat 125 may be applied directly on the plastic molded base 135 without there being any additional layers of paint between the base 130 and the base coat 125. Thus, the base coat 125 may be the only paint layer present on the base 130 underneath the clear coat 120. In that regard, manufacturing the keycap 100 may require less paint than other keycap designs, which traditionally include primer paint layers underneath the base coat.

Furthermore, in yet another aspect, the molded base 130 may act as a light filter. Accordingly, varying the color of the filler used in making the base may enable manufacturers to achieve a uniform glow color while using light sources that each emit light having a (slightly) different color from the rest. Accordingly, when the keycap 100 is manufactured, a color (or type) and/or amount of filler may be selected based on the color of light emitted by the light source 140 and a desired color of glow to be emitted by the symbol inscription 110 when it is backlit (e.g., color of glow specified by a product specification).

Furthermore, in yet another aspect, the amount of filler added to the original base may determine how translucent the original base is. Accordingly, when the keycap 100 is manufactured, the amount of filler that is to be added to the original base may be determined based on the brightness of the glow emitted from the symbol inscription 110 when it is backlit and a desired brightness of glow to be emitted by the symbol inscription 110 when it is backlit (e.g., brightness of glow specified by a product specification).

Figure 1E:
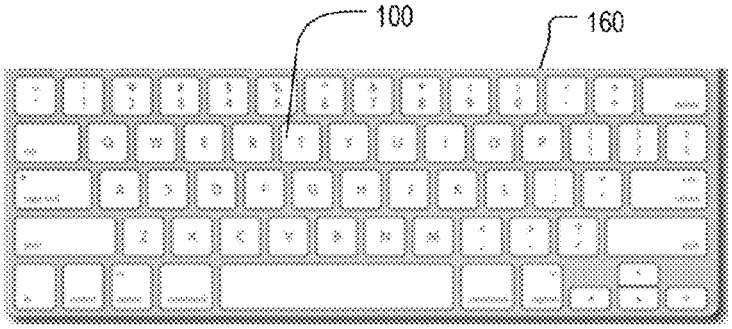

FIG. 1E depicts an example of a backlit keyboard 160 which both the keycap 100 and the light source 140 may be part of. Although in this example the keyboard 100 is a desktop keyboard, in other examples it may be a laptop keyboard, telephone handset keyboard, or any other type of keyboard. Furthermore, although in this example the keyboard includes a plurality of keys (and keycaps), in other examples, the keyboard 160 may include only one key. In that regard, the keyboard 160 may be any electronic or electromechanical device capable of receiving tactile input from a user.

Figure 2:
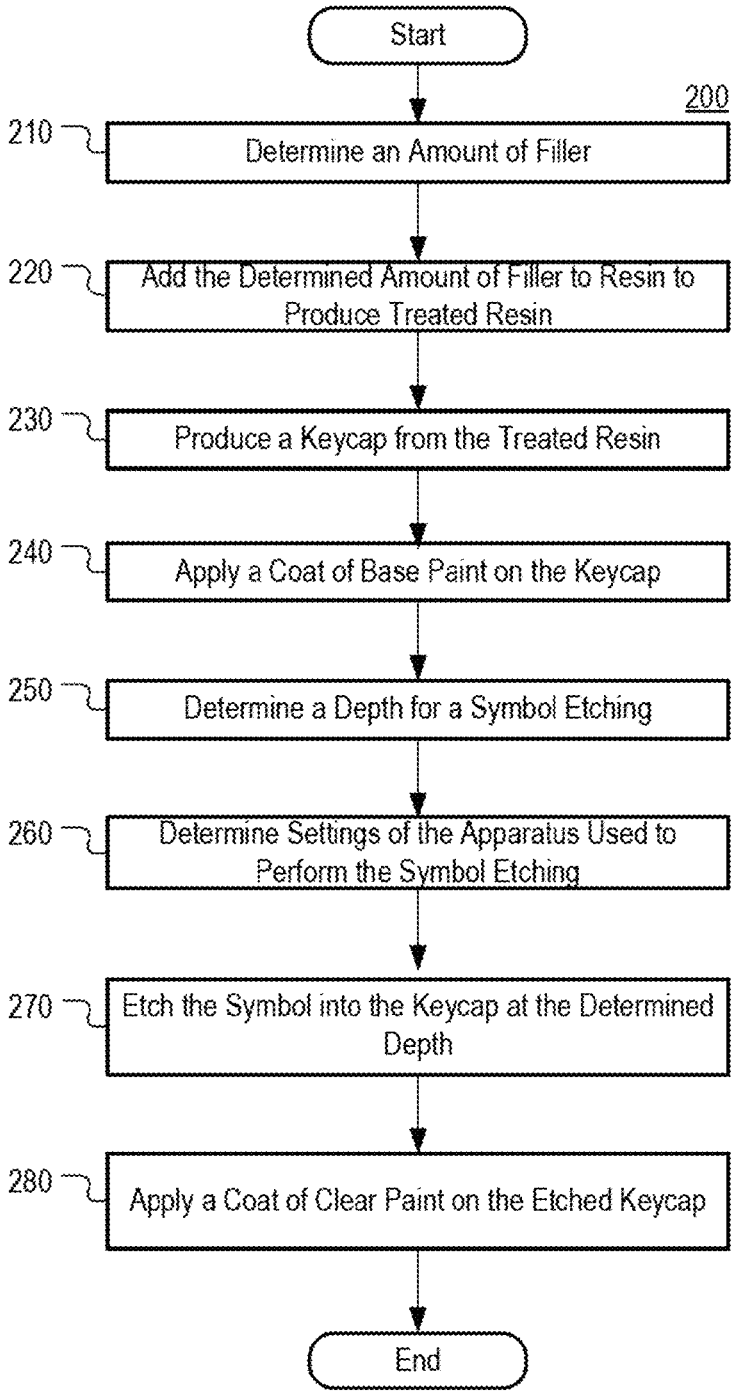
FIG. 2 depicts a flowchart of a process for manufacturing the keycap of FIG. 1A.

FIG. 2 depicts a flowchart of a process for manufacturing the keycap 200 in accordance with one aspect of the disclosure. At task 210, an amount or type of filler that is to be added to an original resin is determined. In some aspects, as noted, the amount or type of filler may depend on the brightness and/or color of a light source that is designated to backlight the keycap 100.

At task 220, the determined amount of filler is mixed with the original resin to produce a treated resin. At task 230, the keycap 100 is produced from the treated resin. To produce the keycap 100, the treated resin may be molded or otherwise put into the shape of the keycap 100. The disclosure is not limited to any specific method for manufacturing the keycap base 130 from the treated resin.

At task 240, the base coat 125 is applied onto the base 130. In some aspects, the base coat 125 may be a different color from the base 130 in order to allow the symbol inscription 110 to stand out when the base coat 125 is etched away to define the symbol. Although in this example the coat of base paint 125 covers the whole exterior of the base 130, in other examples it may cover only a portion thereof, such as the top surface 105.

At task 250, the depth $D_1$ for the etching of the symbol inscription 110 is determined. In some aspects, the depth $D_1$ may depend on the thickness of the base 130. In other aspects, the depth $D_1$ may depend on the brightness of a light source that is designated to backlight the keycap. For example, the dimmer the light source 140, the deeper the groove 135 may be.

At task 260, additional etching settings are determined. Such settings may include power, focus, or burn time of a laser that is used to etch the symbol inscription 110. The burn time may be the time for which any given point of the base 130 is exposed to the laser. In some aspects, the burn time may be selected such that the base 130 does not change color (e.g., become burnt or otherwise change color) due to overexposure to the laser. Setting the burn-time properly may ensure that the color of the symbol inscription 110 remains the same as the color of the keycap base 130.

At task 270, the symbol inscription 110 is etched into the keycap 100 at the determined groove depth and in accordance with the additional etching settings determined at task 260. Although in this example laser etching is used, the disclosure is not limited to any specific method for etching. At task 280, the clear coat 120 is applied onto the etched keycap base 130.

Figure 3:
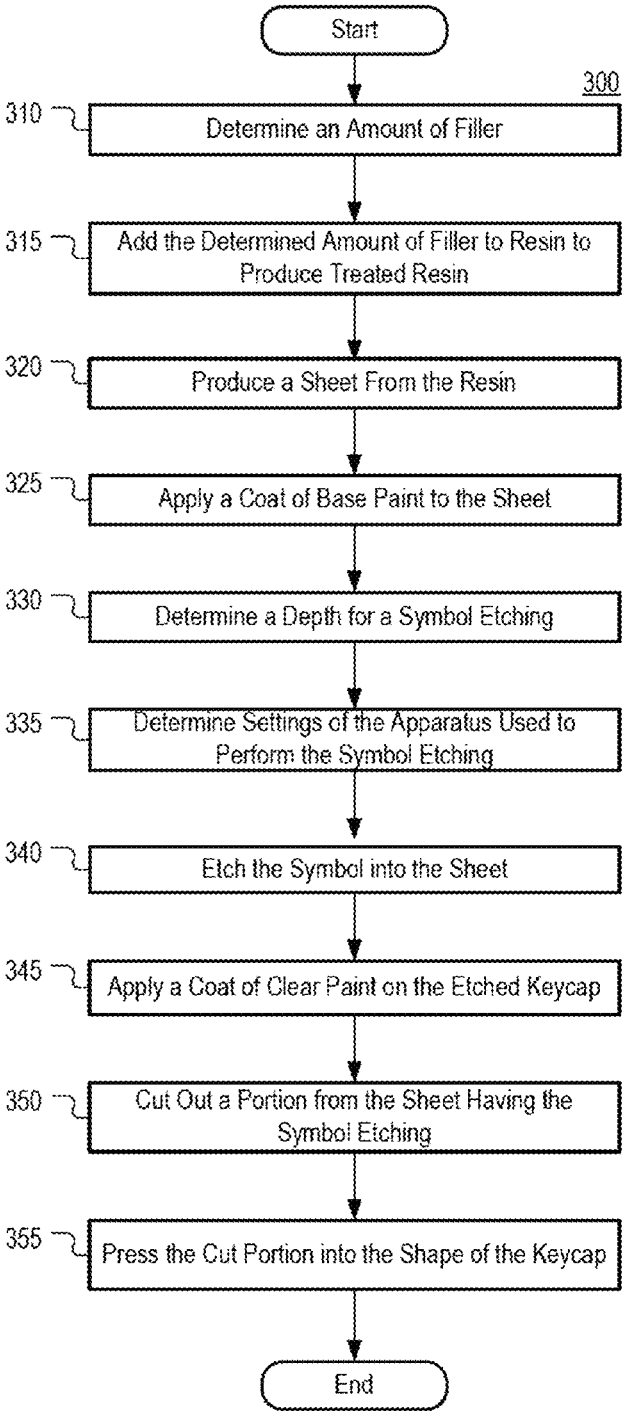
FIG. 3 depicts a flowchart of another process for manufacturing the keycap of FIG. 1A.

FIG. 3 depicts a flowchart of a process 300 for manufacturing the keycap 100. At task 310, an amount and/or type of filler is determined. At task 315, the determined amount of filler is mixed with an original resin to produce a treated resin. At task 320, a sheet is produced from the treated resin. The sheet may have the thickness T. At task 325, the base coat 120 is applied onto the sheet. At task 330, a depth for the etching of the symbol inscription 110 is determined. At task 335, additional settings of the apparatus used to perform the etching are determined. At task 340, the symbol 110 is etched onto the sheet. At task 345, the clear coat 120 is applied on top of the etching. At task 350, a portion of the sheet that includes the etchings is cut. And at task 355, the cut portion is heated and pressed into the shape of the keycap 100.

FIGS. 1A-3 are provided as examples. In some aspects, at least some of the tasks associated with FIGS. 1A-3 may be performed in a different order than represented, performed concurrently, or altogether omitted. As these and other variations and combinations of the features discussed above can be utilized without departing from the subject matter as defined by the claims, the foregoing description of exemplary aspects should be taken by way of illustration rather than by way of limitation of the subject matter as defined by the claims. It will also be understood that the provision of the examples described herein (as well as clauses phrased as "such as," "e.g.", "including" and the like) should not be interpreted as limiting the claimed subject matter to the specific examples; rather, the examples are intended to illustrate only some of many possible aspects.

The invention claimed is:

1. A keycap for use in backlit keyboards, comprising:

a translucent base having a surface, the surface having a first thickness;

a layer of first paint that is applied directly to the surface of the translucent base, the layer of first paint having a second thickness, and the layer of first paint being capable of blocking at least some light that flows through the translucent base; and a groove etched within the surface of the translucent base, the groove extending completely through the second thickness of the layer of first paint, the groove defining a shape of a symbol by exposing parts of the translucent base that are hidden underneath the layer of first paint.

2. The keycap of claim 1, wherein the groove further extends partially through the first thickness of the surface without penetrating the first thickness completely.

3. The keycap of claim 1, further comprising a layer of clear paint at least partially covering the layer of first paint, the clear paint at least partially filling the groove.

4. The keycap of claim 3, wherein the layer of first paint is the only paint layer between the translucent base and the layer of clear paint.

5. The keycap of claim 3, wherein the clear paint only partially fills the groove, thereby leaving a tactile recess on the keycap.

6. The keycap of claim 3, wherein the clear paint substantially fills the groove, thereby causing the groove to appear substantially smooth to a user's touch.

7. The keycap of claim 1, wherein the layer of first paint is opaque and capable of blocking completely any light flowing through the translucent base.

8. A backlit keyboard comprising a light source and a keycap, the keycap including:

a translucent base having a surface, the surface having a first thickness;

a layer of first paint that is applied directly to the surface of the translucent base, the layer of first paint having a second thickness, and the layer of first paint being capable of blocking at least some light emitted from the light source that flows through the translucent base; and a groove etched within the surface of the translucent base, the groove extending completely through the second thickness of the layer of first paint, the groove defining a shape of a symbol by exposing parts of the translucent base that are hidden underneath the layer of first paint.

9. The backlit keyboard of claim 8, wherein the groove further extends partially through the first thickness of the surface without penetrating the first thickness completely.

10. The backlit keyboard of claim 8, further comprising a layer of clear paint at least partially covering the layer of first paint, the clear paint at least partially filling the groove.

11. The backlit keyboard of claim 10, wherein the layer of first paint is the only paint layer between the translucent base and the layer of clear paint.

12. The backlit keyboard of claim 10, wherein the clear paint only partially fills the groove, thereby leaving a tactile recess on the keycap.

13. The backlit keyboard of claim 10, wherein the clear paint substantially fills the groove, thereby causing the groove to appear substantially smooth to a user's touch.

14. The backlit keyboard of claim 10, wherein the layer of first paint is opaque and capable of blocking completely any light flowing through the translucent base.

* * * * *